US007201256B2

(12) United States Patent
Deplazes et al.

(10) Patent No.: US 7,201,256 B2
(45) Date of Patent: Apr. 10, 2007

(54) ELEVATOR INSTALLATION HAVING A VIRTUAL PROTECTION AREA AT THE BOTTOM AND/OR THE TOP OF THE ELEVATOR SHAFT, AND METHOD FOR CONTROLLING THE SAME

(75) Inventors: Romeo Deplazes, Oberrüti (CH); Philipp Angst, Zug (CH)

(73) Assignee: Inventio AG, Hergiswil (CH)

( * ) Notice: Subject to any disclaimer, the term of this patent is extended or adjusted under 35 U.S.C. 154(b) by 428 days.

(21) Appl. No.: 10/483,204

(22) PCT Filed: Jul. 3, 2002

(86) PCT No.: PCT/CH02/00363

§ 371 (c)(1),
(2), (4) Date: Jan. 7, 2004

(87) PCT Pub. No.: WO03/008316

PCT Pub. Date: Jan. 30, 2003

(65) Prior Publication Data

US 2004/0173414 A1 Sep. 9, 2004

(30) Foreign Application Priority Data

Jul. 9, 2001 (EP) ..... 01810673

(51) Int. Cl.
*B66B 1/26* (2006.01)

(52) U.S. Cl. ..... 187/300; 187/279

(58) Field of Classification Search ..... 187/391–396, 187/313, 316, 279, 280, 300–303, 217; 340/541, 340/545.1, 545.3, 545.6, 545.9, 565, 567
See application file for complete search history.

(56) References Cited

U.S. PATENT DOCUMENTS 5,283,400 A * 2/1994 Leone et al. ..... 187/391

(Continued)

FOREIGN PATENT DOCUMENTS

EP 1 110 900 A1 6/2001

*Primary Examiner*—Jonathan Salata
(74) *Attorney, Agent, or Firm*—Klaus P. Stoffel; Wolff & Samson PC

(57) ABSTRACT

An elevator installation with an elevator case, an elevator shaft, and a drive unit. The elevator cage is installed in the elevator shaft to be movable and is controllable by the drive unit so that the elevator cage can be stopped in different positions in the elevator shaft. The elevator shaft is equipped with a detecting device which detects whether a person is standing in a critical zone in the elevator shaft or is about to go into this. The detecting device is connected with the drive unit so that the elevator installation can be transferred to a special mode of operation in case a person is standing in the critical zone or is about to go into this. The drive unit includes special control equipment which in the special mode of operation stops the elevator cage before it moves into the critical zone. In that case the detecting device and the special control equipment are designed to be operationally safe in order to prevent movement of the elevator cage into the critical zone. The special control equipment enables, in the special mode of operation, an undisturbed operation of the elevator cage in a zone outside the critical zone.

23 Claims, 7 Drawing Sheets

U.S. PATENT DOCUMENTS 5,644,111 A * 7/1997 Cerny et al. ..... 187/393
6,173,814 B1 1/2001 Herkel et al.
6,223,861 B1 5/2001 Sansevero
6,550,585 B2 * 4/2003 Schoppa et al. ..... 187/391
6,603,398 B2 * 8/2003 Tinone et al. ..... 340/541
6,615,953 B1 * 9/2003 Steinweg ..... 187/393
6,736,242 B2 * 5/2004 Nygren ..... 187/357

* cited by examiner

Prior Art

ELEVATOR INSTALLATION HAVING A VIRTUAL PROTECTION AREA AT THE BOTTOM AND/OR THE TOP OF THE ELEVATOR SHAFT, AND METHOD FOR CONTROLLING THE SAME

PRIORITY CLAIM

This is a U.S. national stage of application No. PCT/CH02/00363, filed on Jul. 3, 2002. Priority is claimed on that application and on the following application:

Country: EUROPE, Application No.: 01810673.2, Filed: Jul. 9, 2001.

BACKGROUND OF THE INVENTION

An elevator installation comprises, in a conventional manner, an elevator cage, an elevator shaft in which the elevator cage moves and a drive unit for moving the elevator cage.

For reasons of safety, present-day elevator installations are designed so that a protective space in the form of a shaft pit is located at the shaft base in order to ensure that maintenance personnel in the shaft are not placed at risk when the elevator cage travels into the lowermost position in the shaft. Typically, an elevator installation is also designed so that a protective space is located at the upper end of the shaft—called shaft head—so that maintenance personnel undertaking maintenance on the roof of the cage are not put at risk when the cage travels into the uppermost position of the shaft.

This occurs with the most diverse forms of elevator layouts, such as, for example, cable elevators, hydraulic elevators, linear motor elevators, etc.

Due to the safety regulation that a protective space has to be provided in the form of a shaft pit at the lower shaft end, the constructional height of the elevator shaft is higher than actually necessary from the purely technical aspect.

The protective space at the lower shaft end currently has typically a height of 50 cm plus the length of the buffer compressed to a maximum, the buffer being disposed at the shaft base in order to cushion the counterweight or the elevator cage.

An elevator installation with protective space at the lower and upper shaft end is longer by a few meters than the actual floor height of the building served by the elevator. This frequently leads to solutions in which the elevator shaft projects beyond the building. In earlier elevator layouts a part of the drive unit was usually mounted in an engine room above the shaft, i.e. either the elevator installation was dimensioned so that the uppermost floor was not served, since here the engine room inclusive of protective space was located, or the engine room inclusive of protective space was realized on the roof of the building.

With present-day elevator layouts the starting point has fundamentally changed, since increasingly elevator installations are realized in which the drive unit is arranged within the shaft space (elevator without engine room). Nevertheless, even here a protective space has to be planned in at the lower and/or upper shaft end due to regulations, which can be disadvantageous for the aesthetics of the building.

Apart from the aesthetic and constructional problems which result from the necessity of the protective spaces, these protective spaces cause additional costs in the erection of a building.

In current elevator layouts the entire installation is shut down in the case of maintenance. This frequently leads to problems if no other elevator is provided in the same building or if the conveying capacity of the other elevators is insufficient.

It is also important with current elevator layouts that maintenance, assembly, repair or inspection personnel at the base of the elevator shaft or at the head end of the same have access to the various technical and electrical systems.

European Patent Application EP 1052212-A describes equipment which allows work to be carried out in an elevator shaft. According to this patent application a protective space is realized at the upper shaft end in that the counterweight is prematurely stopped at the lower shaft end. The cage—which is connected with the counterweight by way of a cable system—thereby cannot be moved up to the shaft head.

U.S. Pat. No. 6,223,861 describes a safety system for an elevator in which the elevator is moved only at reduced speed if a person stands in the elevator shaft. Whether a person stands in the elevator shaft is ascertained by sensors at the shaft doors. If the elevator moves at reduced speed, special switches at the lower and upper shaft ends stop the cage in order to prevent movement of the cage into the protective space.

Another form of safety system is disclosed in U.S. Pat. No. 6,138,798. In order to ensure the safety of maintenance personnel in the shaft pit, buffers are used, the length of which can be changed. If a person is detected in the region of the shaft pit, the buffers are driven out in order to thus be able to guarantee a protective space of greater height.

A similar approach is known from Japanese Patent Abstract with publication number 0905894, wherein, however, this specification concerns the protection zone at the shaft head.

An electronic safety bus connecting different sensors with a central controller is described in U.S. Pat. No. 6,173,814. An elevator installation based on a safety bus of that kind is particularly safe, since the elevator can be stopped directly when an exceptional situation is detected.

SUMMARY OF THE INVENTION

It is an object of the present invention to eliminate the protective spaces or to reduce the length thereof.

It is a further object of the invention to provide an elevator installation with a shortened shaft.

Moreover, it is an object of the invention to reduce the costs of the elevator installation.

It is a further object to enhance the safety of maintenance personnel.

It is additionally applicable to provide an elevator installation and a corresponding method of controlling the same which can still remain in operation even in the case of maintenance.

The elevator installation according to the invention and the corresponding method offer, depending on the respective form of embodiment, various advantages, such as, for example, an improved building or space utilization. In addition, elevator installations according to the invention are better suited to specially representative buildings and equipment, since due to the shorter mode of construction of the shaft they can be architectonically better integrated into an overall concept. This is particularly important in the case of free-standing elevator installations.

Through the special embodiment of the elevator installation according to the invention the safety of persons in the elevator shaft is ensured at all times and in all circumstances.

The elevator installation according to the present invention is distinguished by smaller dead times, since the operation is maintained, even if to restricted extent, during maintenance.

DETAILED DESCRIPTION OF THE INVENTION

The present invention is substantially independent of the form of elevator layout and of the form of drive that is used. For these reasons in the following the cables or rails, counterweights and other elements are regarded as a constituent of the drive unit and are individually described or discussed only so far as necessary. In addition, the control is considered to be a constituent of the drive unit.

Figure 1:
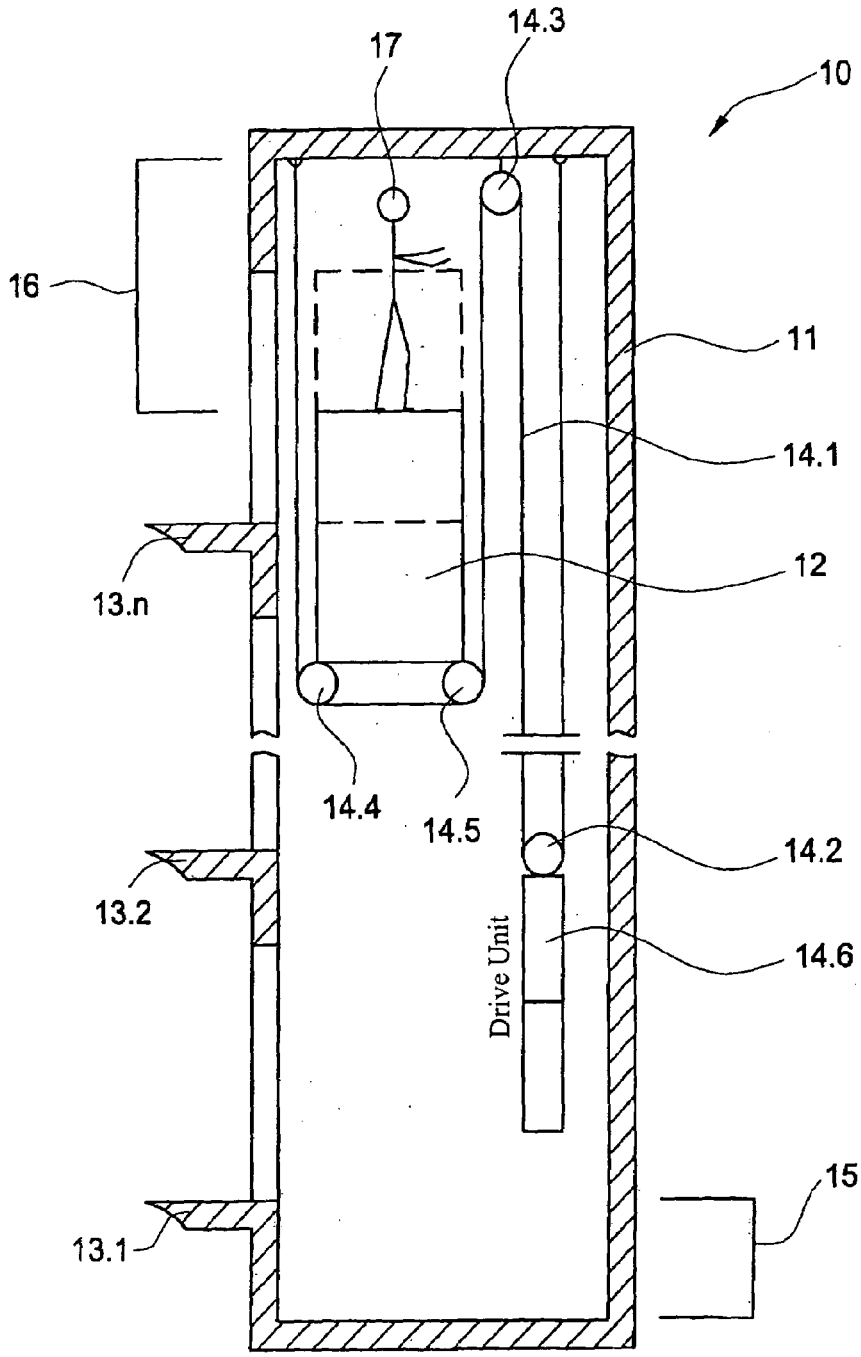
FIG. 1 shows a conventional elevator installation in section.

A conventional elevator installation 10 is shown in FIG. 1. The illustrated installation 10 comprises a shaft 11 with a cage 12, which can travel to different floor levels 13.1 to 13.n. The drive unit comprises the cable 14.1, the rollers or suspensions 14.2 to 14.6, the drive motor (not illustrated) and the control unit for control of the drive motor (not illustrated). A shaft pit 15, which serves as a lower protective space, is disposed at the lower shaft end in accordance with regulations. A protective space 16 is provided at the upper shaft end so that a person 17 located on the roof of the cage 12 is not put at risk.

Figure 2:
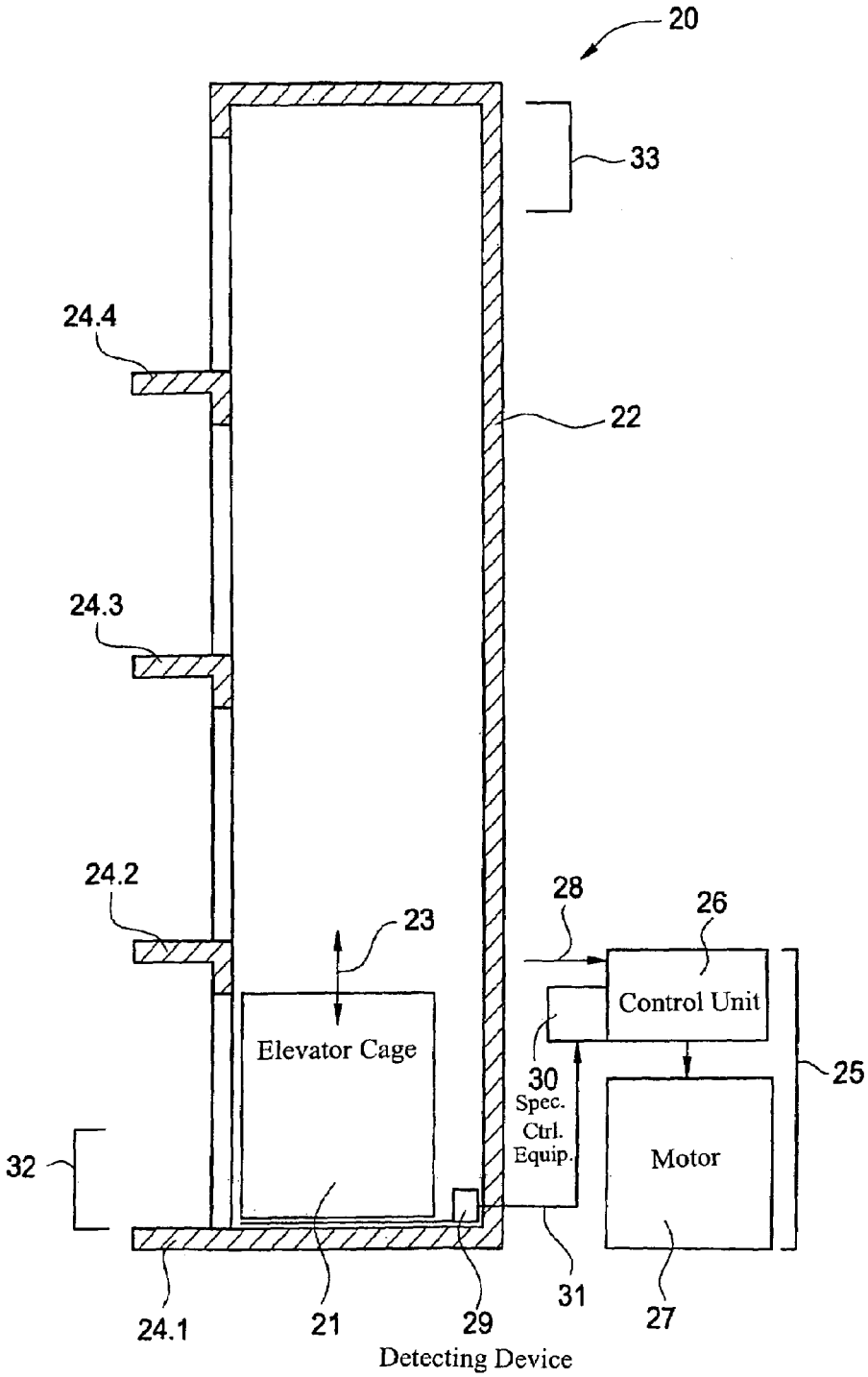
FIG. 2 shows an elevator installation according to the invention in section.

An elevator installation 20 according to the invention is illustrated in FIG. 2. The installation 20 comprises an elevator cage 21 movable in an elevator shaft 22 as indicated by the double arrow 23. The illustrated shaft 22 serves four floor levels 24.1 to 24.4. The cage 21 is driven by way of a drive unit 25. The drive unit 25 comprises a control unit 26 and a motor 27. The control unit receives input signals by way of an input 28, for example from a control keyboard (not illustrated) in the cage 21. The control unit 26 presets an appropriate speed curve in dependence on the input signals and correspondingly regulates the motor 27. The speed curve can be preset in the form of, for example, target values which are compared with extant actual values. In the case of deviations between the actual values and target values a regulating loop comes into effect in order to undertake corrections. The control unit 26 controls the cage 21 so that it can stop—according to the respective requirements—at the different storeys.

Additionally and in dependence on the usual sensors and control means (not shown in FIG. 2) necessary for normal operation of the elevator installation 20 the elevator installation comprises a detecting device 29 which detects whether a person is standing in a critical zone of the shaft 22 or whether a person is about to go into a critical zone of the shaft 22. The end zone 32 at the lower shaft end and/or the end zone 33 at the upper shaft end (shaft head) is or are designated as critical zone or zones. Detection of the presence of a person on the cage roof or entry thereof onto the cage roof is preferably utilized for detection of entrance into the shaft head.

The detecting device 29 is connected with the drive unit 25 in such a manner, for example by way of a line or a bus 31, that the elevator installation 20 is transferrable into a special mode of operation in case a person stands in the critical zone or is about to go into this. According to the invention the drive unit 25 comprises special control equipment 30 which can be integrated in the control unit 26 and which, in the special mode of operation, stops the elevator cage at the latest before the cage moves into the critical zone 32 and/or critical zone 33. The detecting device 29 and the special control equipment 30 are designed in safety-relevant manner in order to prevent movement of the elevator cage 21 into the critical zone 32 and/or critical zone 33 in all circumstances. During the special mode of operation the special control equipment 30 preferably enables undisturbed operation of the elevator cage 21 in a zone outside the critical zone 32 and/or critical zone 33. In the illustrated example the elevator cage 21 in the special operating mode can, for example, continue to serve the floor levels 24.2 and 24.3.

The term 'safety-relevant' is to be understood in the present connection in the sense that it concerns an elevator installation which is reliable and, in particular, operationally safe in that, for example, the most essential components are present in redundant form, important functions of the control equipment (30; 42) elapse in parallel and the results thereof are compared with one another and the data transfer takes way by way of parallel lines or known methods for transmission error recognition are used for that purpose.

Through the use of a suitable detecting device and the special control equipment a virtual protection zone is created at the shaft base and/or at the shaft head at the latest on movement into the critical zone 32 and/or 33. The virtual protection zone must be absolutely safe in order to prevent risk to persons or even personal injury. Only if this is guaranteed is it possible to dispense with a shaft pit or an upper protective space.

Light barriers, light barrier grids, pressure mats, movement detectors, presence detectors, safety locks, door contacts, input units, operating mode selector switches, etc., are suitable as the detecting device 29. The detecting device 29 is so conceived and arranged that it can recognize whether a person wants to enter a critical zone 32 and/or critical zone 33 or has entered. Ideally, several sensors are linked or combined into a detecting device 29 in order to improve the recognition or detection accuracy and in order to design this to be more reliable. The detecting device 29 delivers one or more signals or information to the special control equipment 30. The special control equipment 30 is so linked with the control unit 26 or integrated therein that an immediate switching over to the special mode of operation takes place automatically.

The elements of the detecting device can be arranged at different locations within or outside the shaft 22 and/or at the cage 21.

It is recommended to execute the detecting device 29 separately and independently of the usual sensors and control means of the elevator installation 20 so as to ensure increased safety. In addition, the connection between the detecting device 29 and the special control equipment 30 should be constructed to be self-sufficient in relation to other systems or special safety measures should be undertaken.

Figure 3:
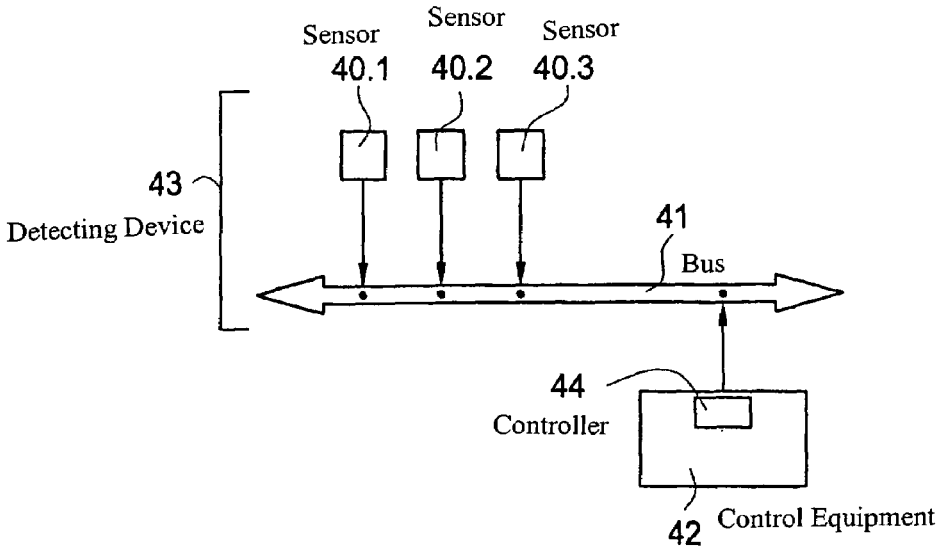
FIG. 3 shows the safety bus of an elevator installation according to the invention as a block diagram.

For example, in a special form of embodiment of the invention there can be used a safety bus as is known from U.S. Pat. No. 6,173,814. Such a form of embodiment is illustrated in FIG. 3. In that case the sensors 40.1, 40.2 and 40.3 of a detecting device 43 are connected with the nodal points of a safety bus 41. The nodal points are illustrated in schematic form as dots. A controller 44 is disposed in the special control equipment 42 or is linked with the special control equipment in order to process and evaluate signals received by way of the safety bus 41. The special control equipment 42 can be designed to be programmable so that certain adaptations and subsequent updates can be undertaken. Rules can be preset which lead to switching over to the special mode of operation. In that case emphasis is placed on the highest possible safety as is demonstrated by way of the following example.

The detecting device 43 comprises three movement sensors 40.1, 40.2 and 40.3. The following rule can be set:

If the sensor 40.1 or the sensor 40.2 or the sensor 40.3 detects a movement, then there is automatic switching over to the special mode of operation.

Figure 4:
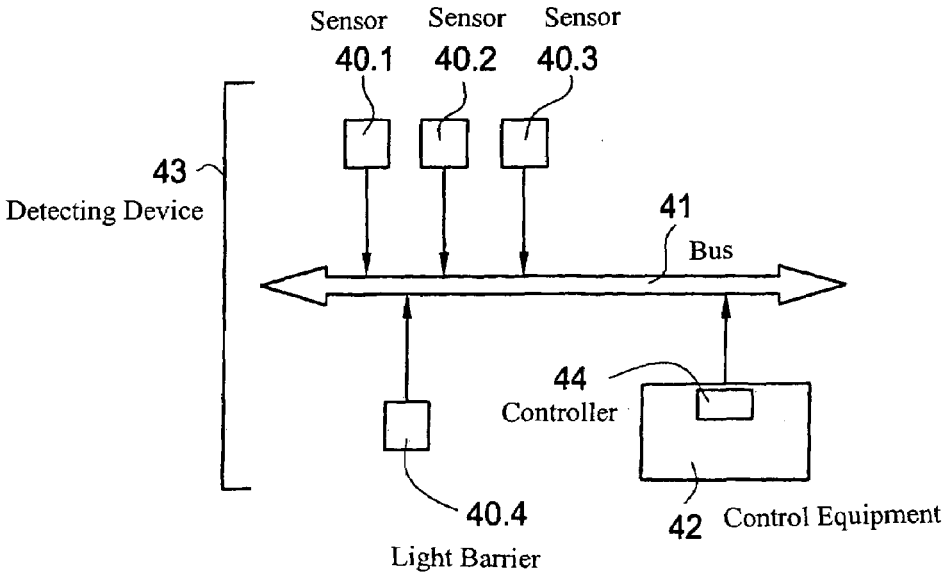
FIG. 4 shows the safety bus of a further elevator installation according to the invention as a block diagram.

A further example could look as follows. In addition to the three movement sensors 40.1 to 40.3, there is also provided a light barrier 40.4 at the lowermost shaft door as shown in FIG. 4. The following rule can be predicated:

If the light barrier 40.4 detects that a person goes through the shaft door and if the sensor 40.1 or the sensor 40.2 or the sensor 40.3 detects a movement, then there is automatic switching over to the special mode of operation.

Figure 5:
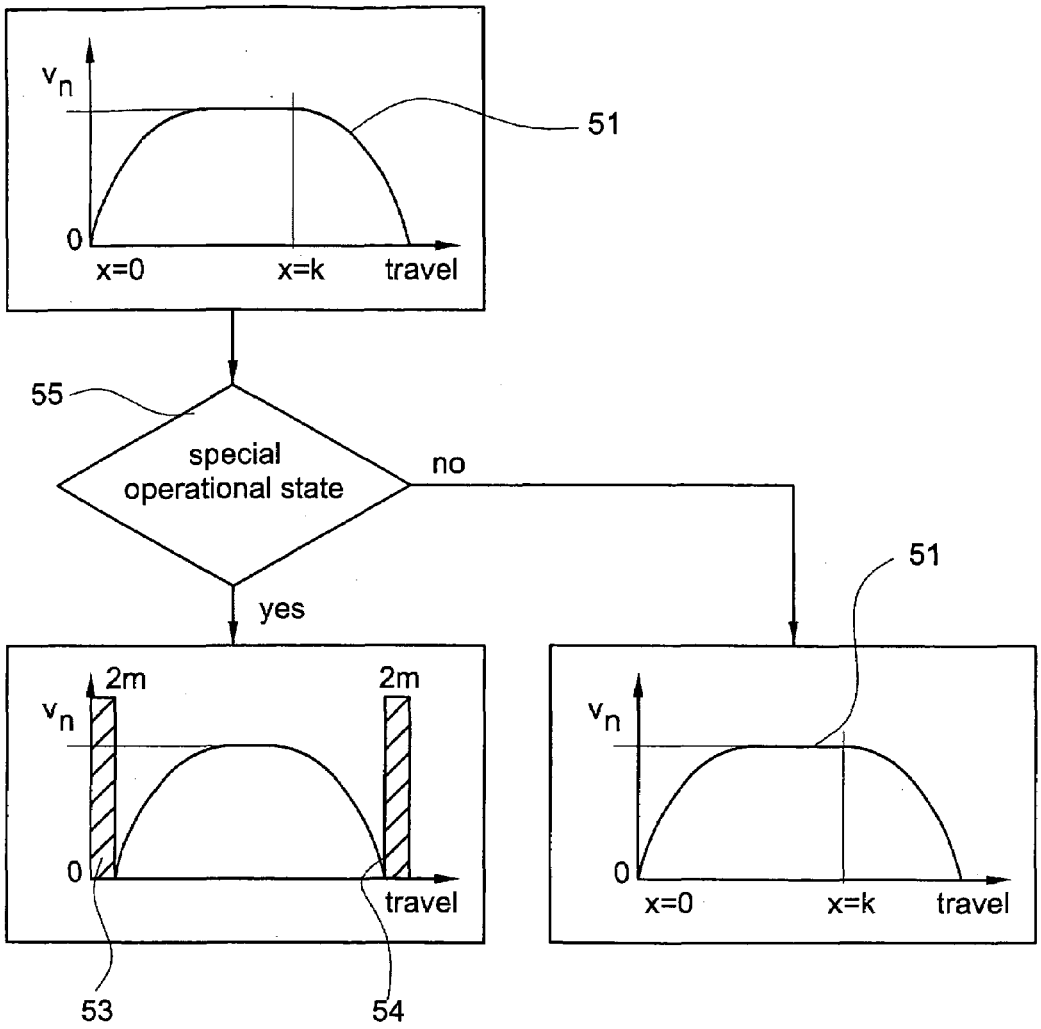
FIG. 5 shows a schematic flow chart according to one form of embodiment of the present invention.

In FIG. 5 there is shown, on the basis of an exemplary curve 51, how a conventional elevator can be controlled. The curve 51 shows speed as a function of travel x which the elevator covers. In the illustrated case the travel length corresponds with the distance between the lowermost and uppermost floor level which the elevator serves. The drive is so controlled not only during start-off, but also during braking, of the elevator cage that low acceleration forces arise.

The curve 51 is a speed target value curve for a journey over the maximum travel path of the elevator cage, for example for a journey from the storey above the shaft pit to the storey below the shaft head. Such a speed target value curve can obviously be generated, depending on the respective travel request, also over only one storey spacing or a few storey spacings. An elevator installation is typically equipped with measurement transmitters which continuously measure actual values of cage position and cage speed and pass these on to the control unit (for example, the control unit 26 in FIG. 2). The speed actual values are then compared with the speed target values. The control unit determines therefrom whether there must be further acceleration, whether the elevator can continue to be moved at the instantaneous speed or whether there has to be braking.

According to the present invention the elevator installation automatically switches over to a special operating mode as soon as anybody is located in the shaft or intends to go into the shaft. An installation according to the invention is distinguished by the fact that the special operating mode enables independent influencing of certain control magnitudes.

In an advantageous form of embodiment the special control equipment 30 according to the invention is connected downstream of the actual control unit 26 of slift an elevator installation and, in particular, so that the special operating mode always has priority over the normal operating mode. The manner of effect of an advantageous form of embodiment is shown in FIG. 5.

The speed target value curve 51 for the maximum possible travel path of the elevator is shown in the uppermost box. The elevator accelerates from standstill at x=0 meters to a normal speed $v_n$. At this normal speed a major part of the travel path is covered up to the point x=k. At this point the braking process is initiated in order to bring the elevator cage gently to a stop. As explained further above, such a curve is usually a speed target value curve. The drive unit of the elevator is controlled by an actual value control in such a manner that the speed actual values correspond as closely as possible with the predetermined speed target value curve.

If the detecting device of the elevator installation according to the invention recognizes that there is switching over to the special operating mode, as illustrated in FIG. 5 by box 55, a changed control of the drive unit of the elevator installation comes into being as indicated by the curve 52. Here the travel path range to which the maximum speed target value curve relates is reduced by the shaft regions to be protected. If switching over to the special operating mode has not been carried out, the speed target value curve 51 continues to be used.

According to the invention, the speed target value curve 51 is adapted to the operating mode by the special control equipment (for example, the special control equipment 30 in FIG. 2). If the elevator installation is disposed in normal operating mode, then the speed target value curve 51 is used. In the special operating mode, thereagainst, the travel path which the elevator cage can at most cover is shortened. This is schematically illustrated by the curve 52 in FIG. 5. In the illustrated example the characteristic course of the speed curve continues to be used. This means that the elevator cage is accelerated and braked as also in normal operation. In addition, the normal speed $v_n$ remains unchanged in the illustrated example. Through shortening of the travel path two virtual protection zones 53 and 54 are created at the shaft foot and at the shaft head. In the illustrated example the height of the two virtual protection zones 53 and 54 amounts in each case to 2 meters.

Figure 6:
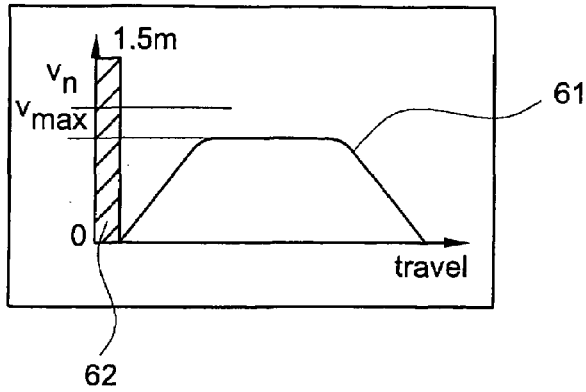
FIG. 6 shows a diagram according to a further form of embodiment of the present invention.

In a further embodiment, which is schematically illustrated in FIG. 6, only one virtual protection zone 62 at the lower shaft end (at x=0 meters) is created. An embodiment of that kind, which in each instance provides only one virtual protection zone 62, can be used when the detecting device is designed so that it can distinguish whether a person stands in the lower or upper shaft region or is about to go into the lower or upper shaft region.

In order to further improve the safety of the elevator installation according to the invention further measures can be undertaken, which are schematically indicated in the same FIG. 6. As a first measure the maximum speed vmax can be reduced in the special operating mode in order to avoid putting service personnel at risk. This can be important if, for example, service personnel stand on the roof of the elevator cage. As a further measure, additionally or alternatively the start-up path and braking path can be designed so that lower acceleration forces arise. A longer time is then needed until the elevator cage picks up speed, and the braking process has to be initiated earlier. In FIG. 6 both measures are used. The virtue protection zone 62 at the lower shaft end is, in the illustrated example, 1.5 meters, which can be sufficient as a protection zone depending on the respective constructional conditions.

Instead of the embodiments described in connection with FIGS. 5 and 6, in which the special control equipment modifies the predetermined speed target value curve, there can be used special control equipment which independently takes over management of the drive control for the entire duration of the special operating mode. In this case the starting point is not the speed target value curve active in the normal operating mode, but the special control equipment presets a suitable curve. Such a curve can be derived from a memory or be generated from a table with parameters or with target values. If the elevator installation is disposed in the special operating mode, then in the embodiment currently described the special control equipment takes over management of the drive control. In addition, in this embodiment a rule mechanism typically comes into use which measures the actual values of the elevator installation and compares them with the target values in order to determine therefrom control magnitudes for the drive control.

In the embodiments described in the foregoing in which the special operating mode contains the restriction of the travel range of the elevator cage, the position thereof and preferably also the speed thereof are monitored at all times in safety-relevant manner so that in the case of movement of the elevator cage into a protection zone the respectively provided braking process can be triggered immediately. Preferably, for the time being stopping is initiated by regulated braking of the drive. In the case of insufficient retardation of the elevator cage, after a short test time, for example by means of opening relays of the drive control and brake control, an emergency stop is triggered by interruption of the current feed to the drive motor and to an electrically actuated device for keeping the drive brake open. If the detected course of braking should still be insufficient, then, after a further short test time, the safety brakes of the elevator cage be activated.

Figure 9:
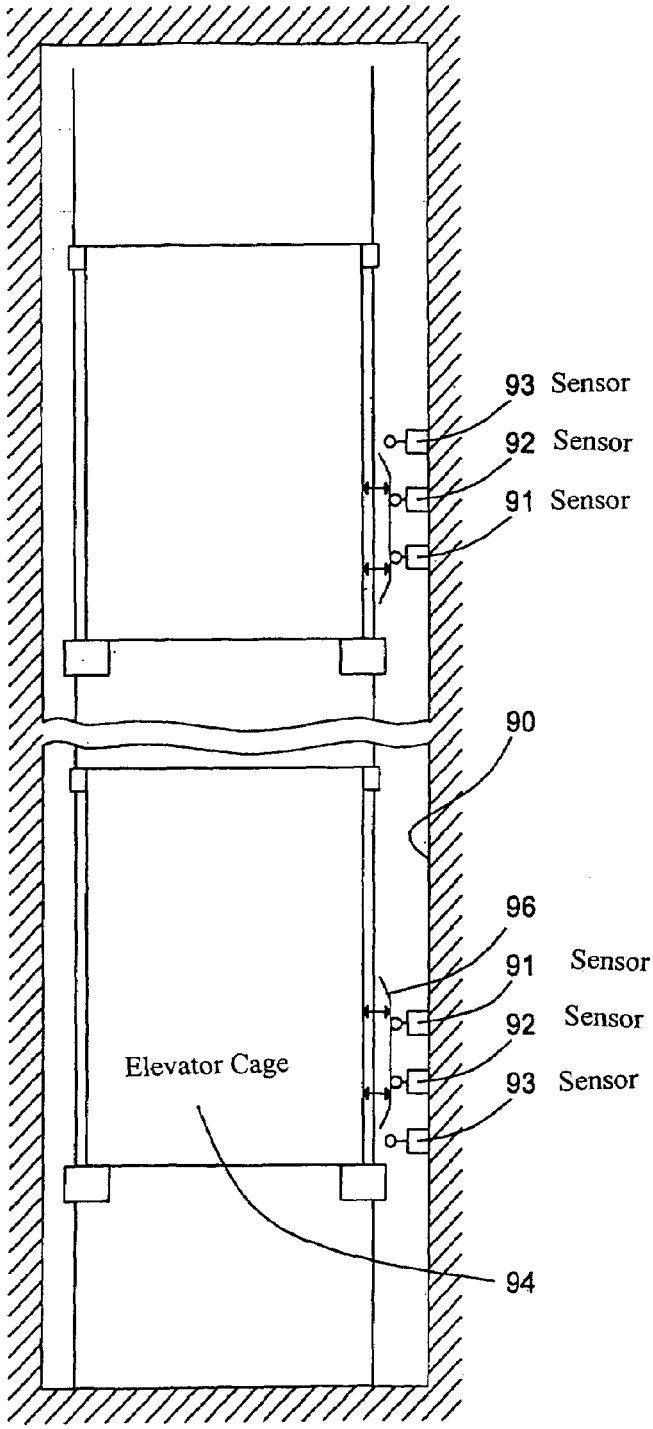
FIG. 9 shows another embodiment of an elevator installation with a restricted travel range in a special operating mode.

FIG. 9 shows a further embodiment of an elevator installation with a travel range restricted in the special operating mode. Sensors 91, 92, 93 are so mounted in the elevator shaft 90 that they can detect movement of the elevator cage 94 into the respective protection zone. They are activated in each instance only in the special operational state and, on detection of the elevator cage, trigger stopping thereof. If in each instance several sensors are arranged in succession in travel direction, then, for example, a first sensor 91 can trigger stopping with regulated drive, a second sensor 92 can trigger the above-described emergency stop and a third sensor 93, which is appropriately spaced from the second, can trigger activation of the safety brake of the elevator cage. However, it is not absolutely necessary to use all mentioned braking stages.

As illustrated in FIG. 9, it can also be provided to actuate the afore-described sensors 91, 92, 93 only in the special operational state, in that a skid 96 is mounted at the elevator cage to be retractable and extensible in such a manner that it actuates the sensors only in the extended state. The skid is extended each time in the special operational state, wherein this can take place by, for example, an electromagnetic actuator.

In addition, extending of the skid 96 can be realized by a device mechanically detecting the presence of a person on the cage roof, for example according to the principle of a lever balance. Equally, the sensors 91, 92, 93 mounted in the region of the shaft pit could be so displaced horizontally relative to the elevator cage by a similar device detecting the presence of a person in the shaft pit that in this situation they can be actuated by a skid fastened to the cage.

According to a further embodiment of the elevator installation the special control equipment is so designed or can be so influenced by maintenance personnel that on transition to the special operational state the elevator installation is stopped without delay. In that case a moving elevator cage is immediately stopped by interruption of the current feed to the drive motor and to an electrically actuated device for keeping the drive brake open, which can be produced by, for example, opening relays of the drive control and brake control. In the case of a version preferred in terms of safety, after expiration of a short test time the safety brakes at the elevator cage can be activated if the resulting braking reaction was detected as insufficient.

In order to make the installation according to the invention safety-relevant, it is recommended to so design the special control equipment that on each occasion there is automatic switching over to the special operating mode as soon as there is detection by the detecting device of a state or a behaviour pattern which indicates that a person is located in the shaft or is about to go into this.

According to a further embodiment the elevator installation is constructed so that every state which cannot be unambiguously interpreted by the special control equipment has the consequence that the installation is automatically transferred to the special operating mode. The special operating mode can be left again only after the presence of further measurement values of the detecting device or after an input has been manually effected. The safety of the elevator installation is further increased by this measure.

Elevator installations according to the present invention can be changed or adapted in that the detecting device is equipped with input means which make it possible for the service personnel to manually influence the control of the elevator installation while they stand in the virtual protection zone. The corresponding input means should be constructed so that the virtual protection zones cannot, however, be prejudiced by the elevator cage. The input means can comprise, for example, a card reader by which service personnel authenticate themselves. A control unit, by way of which the service personnel can influence the elevator control, can be disposed adjacent to the card reader. It is also possible to furnish the service personnel with a portable data processing unit, for example in the form of a portable computer or a Personal Digital Assistant (PDA). The data processing unit can be coupled with the special control equipment by way of a cable connection or by radio or infrared radiation in order to be able to influence the control of the elevator.

A further embodiment is distinguished by the fact that it comprises an indicating device which indicates whether the elevator is disposed in the special operating mode. The indication can be carried out optically or acoustically or by other suitable means. The safety of the entire installation is thereby further increased, since the further personnel are informed by the indication whether switching over to the special operating mode has taken place in problem-free manner.

A further elevator installation according to the invention comprises a card reader or a similar input unit which has to be actuated by service personnel before the elevator shaft is entered. The special control equipment is transferred to a mode of alarm state by actuation of the input unit. If it is then detected by the detecting device that anybody actually passes through the doors to the shaft the special operating mode is activated.

On leaving the elevator shaft an appropriate indication of departure can be undertaken in order to restore the elevator to the normal operating mode.

Figure 7:
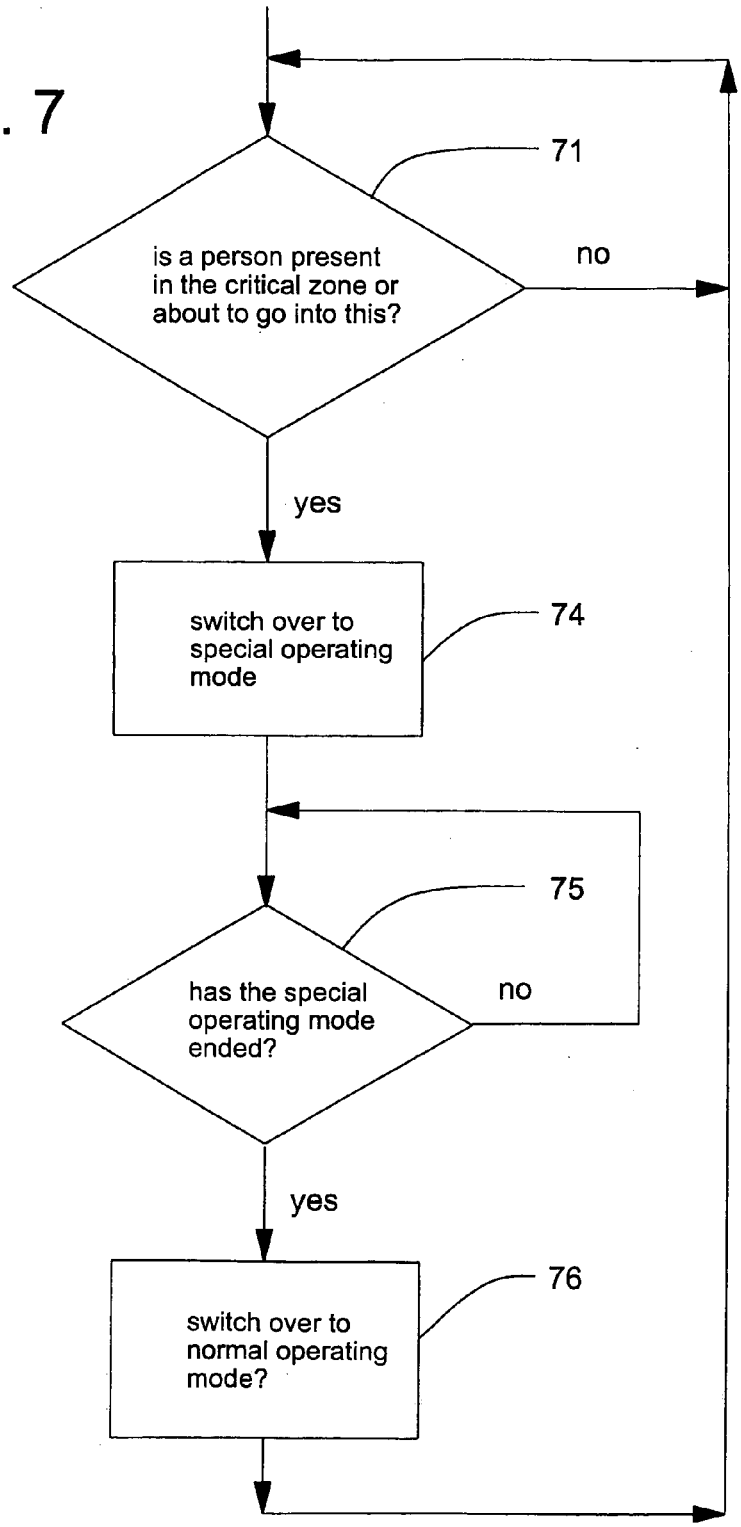
FIG. 7 shows a schematic flow chart according to a further form of embodiment of the present invention.

A method of operating an elevator installation according to the present invention is shown in the flow chart in FIG. 7. In a first step (illustrated by box 71) it is detected whether a person is located in the elevator shaft or whether a person is about to go into this the shaft. This step 71 is preferably carried out by an appropriate detecting device which comprises one or more sensors or input means. If specific criteria are fulfilled, which signify or indicate that a person is located in the elevator shaft or is about to go into this, there is switching over to the special mode as illustrated in box 74.

If the elevator system is disposed in special operating mode, a transition to the normal operating mode has to take place a later point in time. There are various approaches to design a transition of that kind safely.

It is particularly important not to trigger premature or unwarranted switching back to the normal operation. Special safety measures help to avoid this.

For example, the signals of the detecting device can be continuously used in order to obtain a statement about whether anybody is located in one of the critical zones of the elevator shaft. If this should not be the case, then switching back to the normal operation can take place, as indicated in boxes 75 and 76. Advantageously switching back takes place only with a certain delay in time in order to increase safety.

Every situation which is only imaginable should be taken into account in the concept of the installation according to the invention. How does the system behave if service personnel are motionless in the shaft over a longer period of time? What happens if one person leaves the shaft, but another person continues to stay in the shaft? The detecting device should comprise appropriate components, in the form of sensors and other detecting means, to enable a safe decision for all eventualities according to clear rules.

Figure 8:
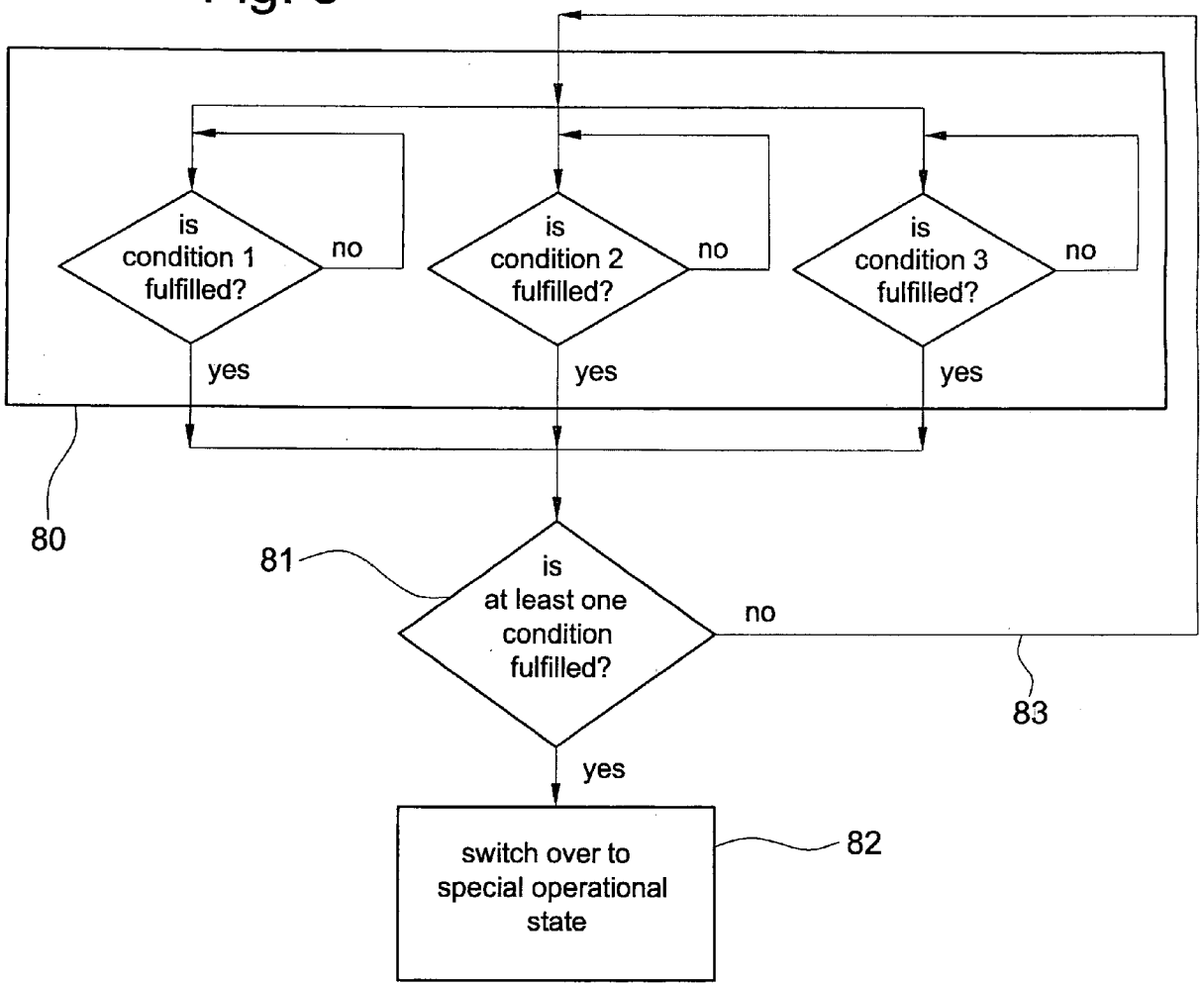
FIG. 8 shows a schematic flow chart according to a further form of embodiment of the present invention.

In FIG. 8 it is illustrated that the detecting device 80 can interrogate several conditions in parallel. In the illustrated example three different conditions 1 to 3 are shown. The condition 1 can, for example, be formulated as follows:

Does a movement sensor report movements in the shaft?

The condition 2 can be formulated, for example, as follows:

Does an infrared sensor report a warm body or object in the detecting range?

The condition 3 can be formulated, for example, as follows:

Is the light beam of a light barrier interrupted permanently or from time to time?

As shown in FIG. 8 by the box 81, any one of the conditions, if it is fulfilled, should trigger switching over to the special operating mode. The step of switching over is shown in box 82. If no switching over takes place, then the flow chart follows the path 83 back to the point where the detecting device is set to continue monitoring.

If the elevator installation is already disposed in the special operating mode, other rules or conditions can come into use. In addition, the various sensors can be linked or the signals evaluated by way of a logic system in order to be able to undertake safer decisions.

In a specific embodiment the special control equipment is designed so that it is secure against failure. In other words, if a disturbance should happen in the elevator system it has to be ensured on every occasion that the virtual protection zone or zones is or are maintained. For this purpose, for example, special safety circuits can be used which ensure on every occasion a transfer to the special operating mode.

The various aspects and features of the individual forms of embodiment can be combined with one another without further measures. In addition, features or advantageous elements which were described or illustrated in conjunction with a specific form of embodiment can be used in conjunction with other forms of embodiment.

Translation of legends in the drawings

FIG. 5:

Weg=travel

Spezieller Betriebszustand=special operational state

Nein=no

Ja=yes

FIG. 6:

Weg=travel

FIG. 7:

Ist eine Person in der kritischen Zone anwesend oder im Begriff, in diese zu gelangen?=is a person present in the critical zone or about to go into this?

In speziellen Betriebsmodus umschalten=switch over to special operating mode

Speziellen Betriebsmodus beenden?=has the special operating mode ended?

In normalen Betriebsmodus umschalten?=switch over to normal operating mode?

Nein=no

Ja=yes

FIG. 8:

Ist Bedingung 1 erfüllt?=is condition 1 fulfilled?

Ist Bedingung 2 erfüllt?=is condition 2 fulfilled?

Ist Bedingung 3 erfüllt?=is condition 3 fulfilled?

Ist mindestens eine Bedingung erfüllt?=is at least one condition fulfilled?

In speziellen Betriebszustand umschalten=switch over to special operational state Nein=no Ja=yes

The invention claimed is:

1. An elevator installation, comprising:

an elevator cage;

an elevator shaft;

and a drive unit, the elevator shaft being equipped with a detecting device that detects whether a person is standing in a critical zone in the elevator shaft or is about to go into the critical zone, the detecting device being connected with the drive unit so that the elevator installation is transferrable into a special operating mode in case a person is standing in the critical zone or is about to go into the critical zone, and the drive unit includes special control equipment which is operative in the special operating mode to prevent movement of the elevator cage into the critical zone, the special control equipment is operatively configured so that in the special operating mode operation of the elevator cage is possible without restriction outside the critical zone.

2. An elevator installation according to claim 1, wherein the detecting device includes at least one sensor.

3. An elevator installation according to claim 2, wherein the sensor is linked with the special control equipment by one of a line and a bus.

4. An elevator installation according to claim 3, wherein the detecting device and the special control equipment are designed in safety-relevant manner in order to ensure a high level of failure safety.

5. An elevator installation according to claim 4, wherein essential components are present in redundant form, important functions of the control device elapse in parallel and results thereof are compared with one another and data transmission takes place by way of parallel lines.

6. An elevator installation according to claim 1, wherein a control is provided which is one of lineable with the special control equipment and has the special control equipment integrated therein.

7. An elevator installation according to claim 6, wherein the detecting device comprises a bus.

8. An elevator installation according to claim 7, wherein the detecting device is a safety bus.

9. An elevator installation according to claim 1, further comprising a target value/actual value control.

10. An elevator installation according to claim 9, wherein the special control equipment is operative to convert a target value curve of the target value/actual value control by computation in order to thus ensure at least one of a virtual protection zone at a lower shaft end and a virtual protection zone at an upper shaft end.

11. An elevator installation according to claim 1, wherein the special control equipment is operative to take over control of the drive unit in the special operating mode in order to thus ensure at least one of a virtual protection zone at a lower shaft end and a virtual protection zone at an upper shaft end.

12. An elevator installation according to claim 1, wherein the special control equipment is rule-based control equipment which makes decisions based on preset or presettable rules.

13. A method of controlling a drive unit of an elevator installation, which moves an elevator cage in an elevator shaft, the method comprising the steps of:

detecting with a detecting device whether a person is standing in a critical zone within the elevator shaft or is about to go into the critical zone; and automatically switching over the drive unit to a special operating mode in case a person is standing in the critical zone or is about to go into the critical zone, wherein control of the elevator cage in the special operating mode is influenced by special control equipment so that movement of the elevator cage into the critical zone is prevented, the elevator cage after switching over to the special operating mode can continue to move in a zone outside the critical zone.

14. A method according to claim 13, wherein the detecting device passes on signals or information to the special control equipment.

15. A method according to claim 14, wherein the special control device decides, based on the signals or information, whether switching over to the special operating mode takes place.

16. A method according to claim 15, wherein the detecting device comprises at least one sensor which is evaluated or interrogated in the detecting.

17. A method according to claim 13, wherein the special control equipment converts a target value curve of a target value/actual value control by computation or activates a stored target value curve in order to ensure at least one of a virtual protection zone at a lower shaft end and a virtual protection zone at an upper shaft end.

18. A method according to claim 13, wherein the special control equipment takes over control of the drive unit in the special operating mode in order to ensure at least one of a virtual protection zone at a lower shaft end and a virtual protection zone at an upper shaft end.

19. A method according to claim 13, wherein the special control equipment is rule-based control equipment which makes decisions based on preset or presettable rules by checking conditions and triggering an automatic switching over to the special operating mode when at least one of the rules is fulfilled.

20. A method according to claim 13, wherein the special control equipment cancels the special operating mode after occurrence of an event.

21. A method according to claim 20, wherein the event is triggered manually or automatically.

22. A method according to claim 13, including, during the special operating mode, moving the elevator cage at least one of at a reduced speed, with low-start-off and braking accelerations and with shortened travel path.

23. A method according to claim 13, including, during the special operating mode, not moving the elevator cage.

* * * * *